US005177935A

United States Patent [19]

Jones et al.

[11] Patent Number: 5,177,935

[45] Date of Patent: Jan. 12, 1993

[54] PACKING MACHINE

[75] Inventors: David Jones, St. Helens; Jeffrey A. Norris, Wirral, both of England

[73] Assignee: Pilkington Insulation Limited, United Kingdom

[21] Appl. No.: 687,320

[22] Filed: Apr. 18, 1991

[51] Int. Cl.[5] ..... B65B 63/02

[52] U.S. Cl. ..... 53/433; 53/439; 53/450; 53/511; 53/529; 53/550

[58] Field of Search ..... 53/87, 138.4, 405, 427, 53/432, 433, 439, 493, 450, 451, 511, 529, 530, 550, 551, 552

[56] References Cited

U.S. PATENT DOCUMENTS

| | | | |
|---|---|---|---|
| 3,274,746 | 9/1966 | James et al. | 53/511 X |
| 3,381,440 | 5/1968 | Hullhorst | 53/24 |
| 3,458,966 | 8/1969 | Dunbar et al. | 53/24 |
| 3,546,846 | 12/1970 | Sens | 53/433 |
| 3,837,138 | 9/1974 | Terry | 53/530 X |
| 4,084,390 | 4/1978 | Schmachtel et al. | 53/77 |
| 4,106,262 | 8/1978 | Aterianus | 53/450 |
| 4,223,508 | 9/1980 | Wells | 53/552 X |
| 4,251,975 | 2/1981 | Krein | 53/529 |
| 4,272,944 | 6/1981 | Suga | 53/511 |
| 4,537,016 | 8/1985 | Shanklin et al. | 53/493 |
| 4,592,193 | 6/1986 | Gustavsson | 53/530 |
| 4,727,707 | 3/1988 | Hadden | 53/451 |
| 4,757,668 | 7/1988 | Klinkel et al. | 53/451 |
| 4,964,259 | 10/1990 | Ylvisaker et al. | 53/451 X |

FOREIGN PATENT DOCUMENTS

| | | |
|---|---|---|
| 0131475 | 1/1985 | European Pat. Off. . |
| 2347259 | 11/1977 | France . |
| 2125760 | 3/1984 | United Kingdom . |

*Primary Examiner*—John Sipos
*Assistant Examiner*—Daniel Moon
*Attorney, Agent, or Firm*—F. Eugene Davis, IV

[57] ABSTRACT

A packing machine for wrapping compressed insulation products in heat sealable plastic film, including a forming tube having product feed means to move or hold the product within it, a former to reconfigure a web of heat sealable plastic film into a longitudinally open tube around the forming tube, a heat welder to close the longitudinal opening and provide a continuous plastic tube, take-off conveyors which receive the plastic tube containing the product at a point downstream of the forming tube and displace the product a preset distance from the forming tube to create a pocket, means to close the plastic tube behind the displaced product and ahead of the next product which is fed into the forming tube as the product is displaced, and means to cut the plastic tube between the two closures so formed, characterised in that air is removed from the pocket before closure by applying vacuum, thereby reducing the time for closing the plastic tube. The invention also encompasses a method of using the packing machine.

16 Claims, 6 Drawing Sheets

PACKING MACHINE

BACKGROUND OF THE INVENTION

This invention relates to packing machines, particularly to thermal insulation packing machines and to the use of such packing machines to pack pre-compressed rolls of thermal insulation.

Thermal insulation such as glass fibre or rock wool is produced in the form of a continuous mat or web which is cut to lengths and may be compression rolled on a machine such as that described in European Patent No. 131475. That machine ensures that the compressed roll is prevented from unwinding by applying a sheet of paper around the curved surface of the cylinder. To prevent loss of fibres or damage to the roll so formed, it is usual to wrap this compressed cylinder in polythene. To do this the roll is transferred to a packing machine which first aligns the roll with the web from a large roll of polythene and then leads the edge of the polythene around the roll of insulation. Nominally only one length of insulation cylinder can be wrapped by such a machine, which leads to the need to have multiple machines when production needs to be switched from one type of insulation product to another having a different length. Furthermore, the exposed ends of the polythene need to be clipped to seal the package and in the known process this clipping operation requires the excess polythene to be gathered by rotating the entire roll and package slowly past gathering brushes and then applying the clips simultaneously to each end of the pack. The main drawbacks of this system are that the process is slow. Also it is not easy to get the polythene to wrap tightly about the insulation roll, which gives rise to ballooning of the package. This is both unsightly and costly because it could entail the product taking up more room during storage and transport. The slow speed of operation means that several such machines have to be used to take the output of a single compression rolling machine and this is expensive and wastes valuable floor space.

Insulation packing machines are also known in which the polythene wrapping material is welded into a continuous tube longitudinally around the insulating material. Such a machine is described in GB patent application No. 2125760A which is primarily for wrapping stacks of insulation in slab form. The machine compresses the slabs between two conveyors which feed the compressed insulation into a welded plastic tube. The tube is formed from a special double folded roll of polythene. Because the insulation will ultimately be held in compression by the polythene tube itself, it is necessary to allow the longitudinal heat weld to cool and strengthen before the conveyors can actually deliver the insulation into a free-standing tube of plastic. This makes the process cycle time excessively long. In one version of this machine, transverse heat welds are made between the stacks of insulation slabs. To make such welds the polythene must be gathered between two bars and to prevent overstretching of the polythene during this gathering, the insulation pack that is already inside the tube with its remote end sealed, must be free to move backwards. Thus, the excess tube length is created in the void between the two stacks of insulation slabs by removing the half sealed pack to a larger distance than is required for it to clear the transverse heat welding equipment and then allowing it to move back nearer to that minimum clearance. This extra movement slows the process considerably because the half sealed pack can only be removed at the rate that continuous tube can be formed by the longitudinal welding around the compression conveyors, and whilst in principle more heat could be applied, this would in practice cause overheating and increase the time that the weld would have to be allowed to cool before the process cycle could continue. A further disadvantage of this process is that air is trapped in the tube area between the two stacks of slabs and tends to be compressed when the volume is reduced by application of the gathering bars and backward motion of the half sealed pack. This air causes ballooning of the pack which is then partially eliminated when the pack and contents are removed from the effect of compression due to the conveyors above and below the pack. It will be appreciated that such over-compression is undesirable because it damages the insulation, particularly if it is glass fibre insulation. Furthermore, it is difficult to apply such compression to a roll which is sheathed in paper.

SUMMARY OF THE INVENTION

According to the present invention a packing machine for wrapping compressed insulation products in heat sealable plastic film, includes a forming tube having product feed means to move or hold the product within it, a former to reconfigure a web of heat sealable plastic film into a longitudinally open tube around the forming tube, a heat welder to close the longitudinal opening and provide a continuous plastic tube, take-off conveyors which receive the plastic tube containing the product at a point downstream of the forming tube and displace the product a preset distance from the forming tube to create a pocket, means to close the plastic tube behind the displaced product and ahead of the next product which is fed into the forming tube as the product is displaced, and means to cut the plastic tube between the two closures so formed, characterised in that air is removed from the pocket before closure by applying vacuum, which provides the advantage that the time for closing the plastic tube is considerably reduced and the overall cycle time for packaging a product is much faster. The application of vacuum in this way also reduces the moisture content of the product. Typically the number of products that can be packaged in a minute is increased by 50% e.g. from 8 to 12. Preferably the product feed means comprises one or more belt conveyors. Alternatively a pusher system could be used. The plastic film may be fed past the heat welder by means of plastic film feed conveyors.

The vacuum is advantageously applied within the forming tube and most advantageously it is applied by means of two extraction ducts adjacent either side of each product feed conveyor. This has the advantage that the air is being withdrawn from the space created by the inevitable distortion of the product as it is gripped and conveyed by the product feed conveyors.

Preferably the vacuum is provided by one or more bag filter assemblies which has the advantage that as the vacuum is applied loose fibres are removed from the insulation products and retained within the bag filter unit, thus leaving a cleaner and more dust-free final product.

Vacuum may also be applied to a nozzle in the forming tube, which is conveniently sited on the upper circumference of the forming tube upstream of the area around which the plastic film is formed into a tube. The advantage of the provision of such a nozzle is that additional vacuum can be applied to the volume within the forming tube in the case that undersized units are being fed into the forming tube which would leave a void space within the forming tube. The vacuum is desirably further enhanced by the provision of a suitably shaped baffle plate to substantially close the entrance to the forming tube around the stream of undersized products.

The forming tube may be cylindrical and the product feed conveyors may comprise two low profile conveyors located on opposite sides of the forming tube.

By the application of high levels of vacuum to the nozzle and the use of a baffle plate which completely seals the entrance to the forming tube, products can be vacuum shrunk and held in their reduced size by means of closely spaced take off conveyors until the pack is rendered airtight by clipping.

According to the invention there is also provided a method for packing compressed insulation product in heat sealable plastic film comprising, feeding product into a forming tube by means of product feed conveyors, sensing when a lead unit has reached the downstream end of the forming tube and clamping it in that position by stopping the product feed conveyors, feeding a web of heat sealable plastic film around a former to generate a plastic tube with a longitudinal opening around the forming tube, expelling the lead unit from the forming tube by action of the product feed conveyors whilst longitudinally heat welding the plastic tube and feeding it over the downstream end of the forming tube to wrap around the product, gripping the plastic tube containing the product by take-off conveyors and conveying the product until it is completely removed from the forming tube and is displaced from it by a preset distance, whilst advancing the next product to the end of the forming tube by operation of the product feed conveyors, thereby creating a pocket within the plastic tube between the rear of the lead unit and the front of the next unit, closing the plastic tube behind the lead unit and ahead of the next unit and optionally cutting the plastic tube between the two closures so formed, characterised in that air is removed from the pocket, prior to the closing, by application of a vacuum.

Advantageously the plastic tube is fed into the pocket by further operation of plastic film feed conveyors after the lead unit has been displaced by the preset distance. This is advantageous because it eliminates the necessity to displace the lead unit further than the position that it needs to be in for end closure and then reverse the direction of motion of the lead unit to generate the excess tube in the pocket space. The particular advantage of the new process is that the number of consecutive process operations are reduced thereby reducing the overall process time. Desirably the closure is created by gathering the plastic first in one plane and then in a second plane perpendicular to the first and then fitting a clip to hold the plastic in the gathered configuration, the advantage of using a clip in this way is that it provides a fast and secure means to close the packages which is able to withstand the tension due to the tautness of the packing immediately without any requirement to cool a heat weld to strengthen it. The plastic film may be preprinted and sensing means may ensure that the units are aligned to be in register with the printing. Such a system provides attractive packaging. The product and the forming tube may be substantially cylindrical which allows the packing machine to accept conventional rolls of compressed insulation material which may be retained under compression prior to introduction into the forming tube by means of a cylindrical paper wrapping.

In a modification of the process a roll of insulation material, which has a diameter which is significantly less than the diameter of the forming tube and the welded plastic tube, has the plastic tube wrapped tightly about it due to the application of additional vacuum to the space above the roll within the forming tube and the use of a suitably shaped baffle plate across the entrance to the forming tube to maintain the vacuum within the forming tube.

In a further modification of the process a roll of insulation having an initial diameter substantially the same as or smaller than that of the forming tube is caused to have its average diameter reduced by the application of vacuum within the plastic tube and held at the reduced diameter while it is clipped to render it substantially airtight. A containment sleeve may then be applied to retain the reduced diameter in the event the pack becomes punctured.

BRIEF DESCRIPTION OF THE DRAWINGS

The invention will now be described, by way of example only, and with reference to the accompanying drawings, of which.

DESCRIPTION OF THE PREFERRED EMBODIMENTS

Figures 1, 2:
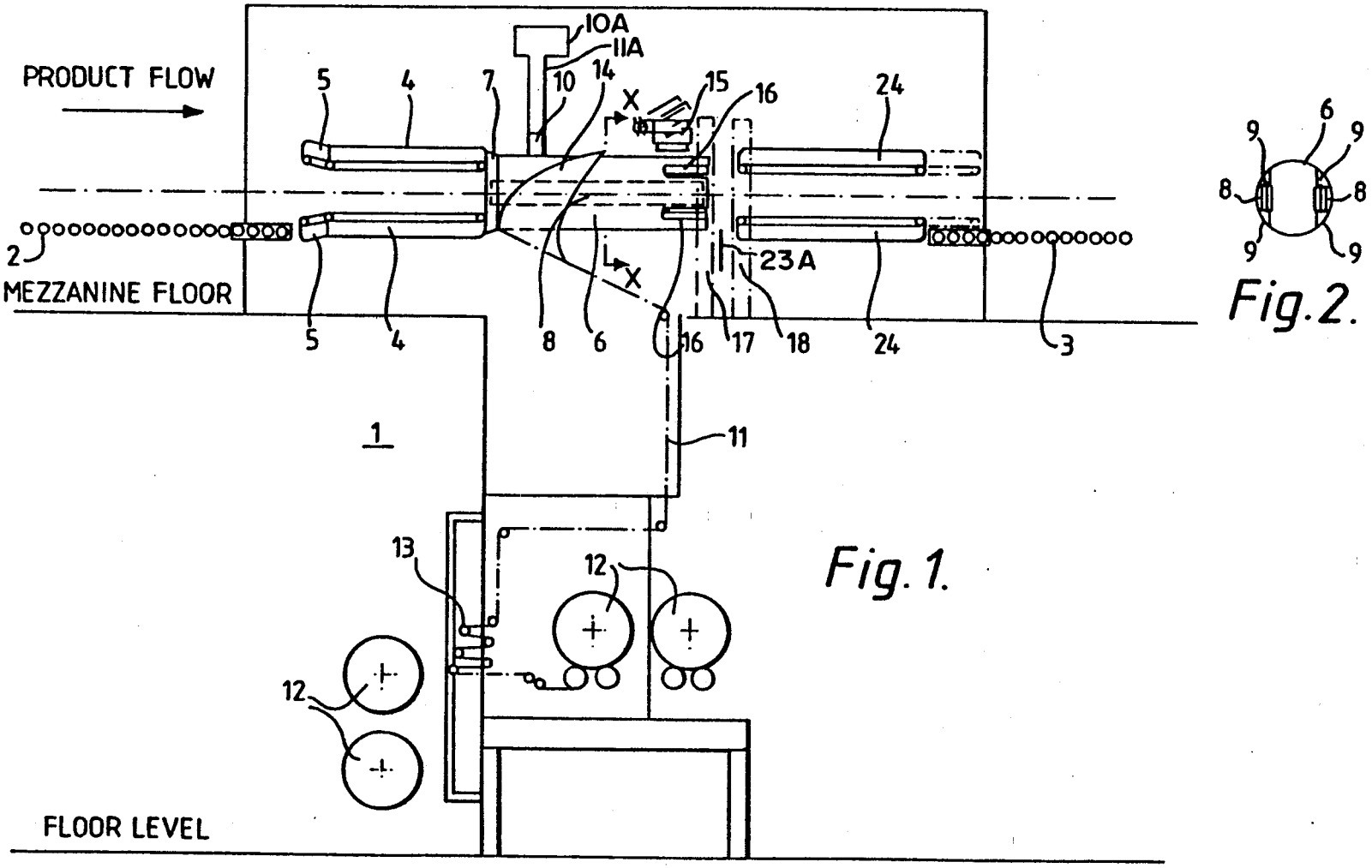
FIG. 1 is a schematic side elevation of a thermal insulation packing machine.
FIG. 2 is a transverse cross section taken through x-x on FIG. 1.

FIG. 1 shows a packing machine 1 located between an incoming conveyor 2 and an outgoing conveyor 3. Adjacent the incoming conveyor 2 are four belt feed conveyors 4 each having a diverging portion 5 immediately adjacent the end of the incoming conveyor 1. Immediately adjacent the end of the belt feed conveyors 4 remote from the incoming conveyor 2 is a cylindrical forming tube 6 having a flared entry portion 7.

As shown in FIG. 2, disposed laterally along the interior wall of the forming tube 6 are two product feed conveyors 8. Above and below each of the product feed conveyors 8 is an extraction duct 9

Referring again to FIG. 1 provision is also made for further vacuum to be applied to forming tube 6 through nozzle 10 located on the upper portion of forming tube 6 towards the end having the flared entry portion 7.

Beneath the forming tube 6 is a system for continuously feeding a web of heat sealable plastic film 11 from one or more of rolls 12. The film 11 is fed around an accumulator 13 before being led over a forming shoulder 14 so shaped that the film is formed into a cylinder around the forming tube 6. A heat welder 15 is provided to weld the plastic cylinder into a continuous plastic tube and plastic film feed conveyors 16 are provided to advance the continuous plastic tube over the forming tube 6.

Downstream of the forming tube 6 are situated two plastic tube gathering and clipping systems 17 and 18.

Figure 3:
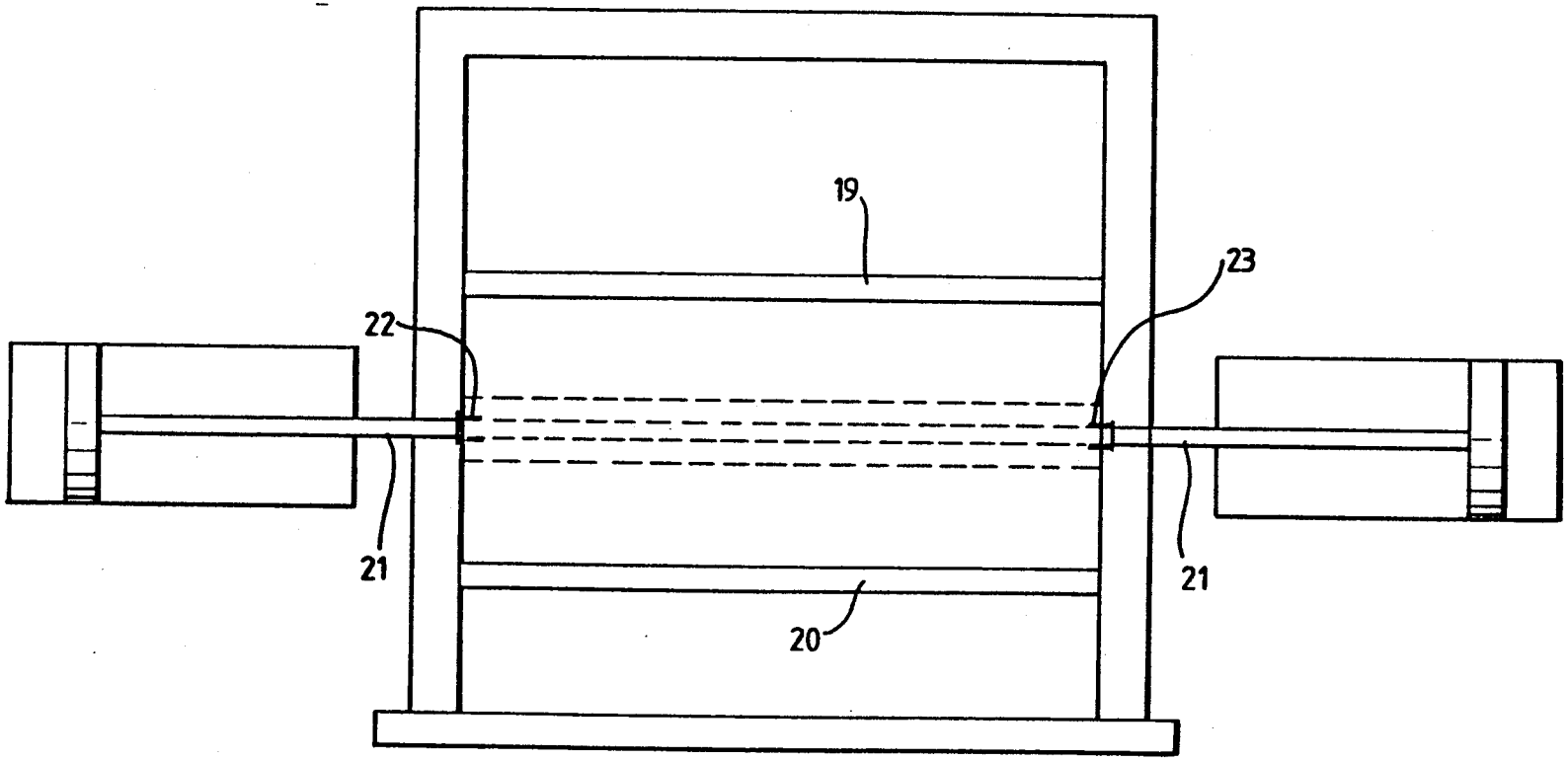
FIG. 3 shows part of a gathering and clipping system.

One of these is shown in more detail in FIG. 3. It comprises two horizontal bars 19,20 which can move towards and away from each other. An upper bar 19 is positioned above the plastic tube and a lower bar 20 is positioned below it. Each bar has a groove running along its length on the side facing the plastic tube. Pistons 21 are arranged to move inwardly along the grooves when the bars 19 and 20 are brought together. A metal clip 22 is held by on of the pistons and a forming head 23 on the other piston is arranged to bend the clip around a gathered plastic tube when the pistons, 21, meet at the center of the grooves. A reciprocating cutting tool 23A is positioned between the two gathering and clipping systems 17 and 18.

Downstream of the plastic tube gathering and clipping system 18 are take-off conveyors 24 which adjoin outgoing conveyor 3.

Figure 4:
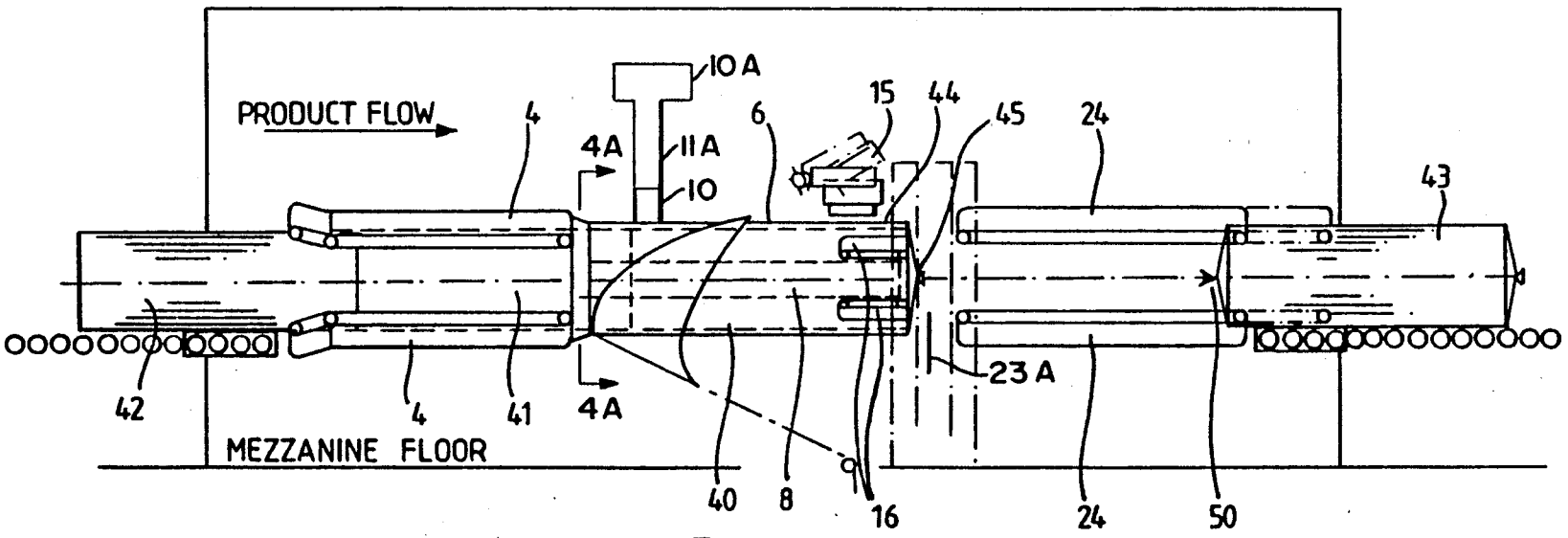
FIGS. 4, 5 and 6 show the operating cycle of a packing machine, FIG. 4A taken along the line 4A—4A of FIG. 4 shows a baffle plate 60.
Figure 5:
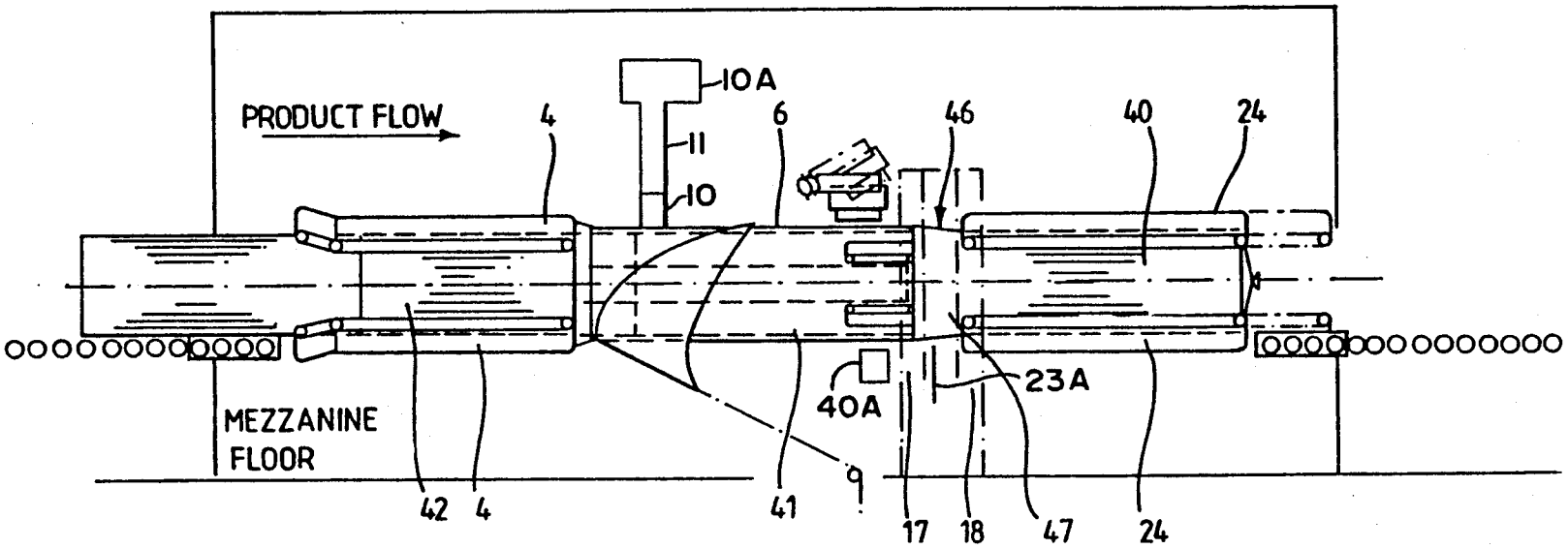
Figure 6:
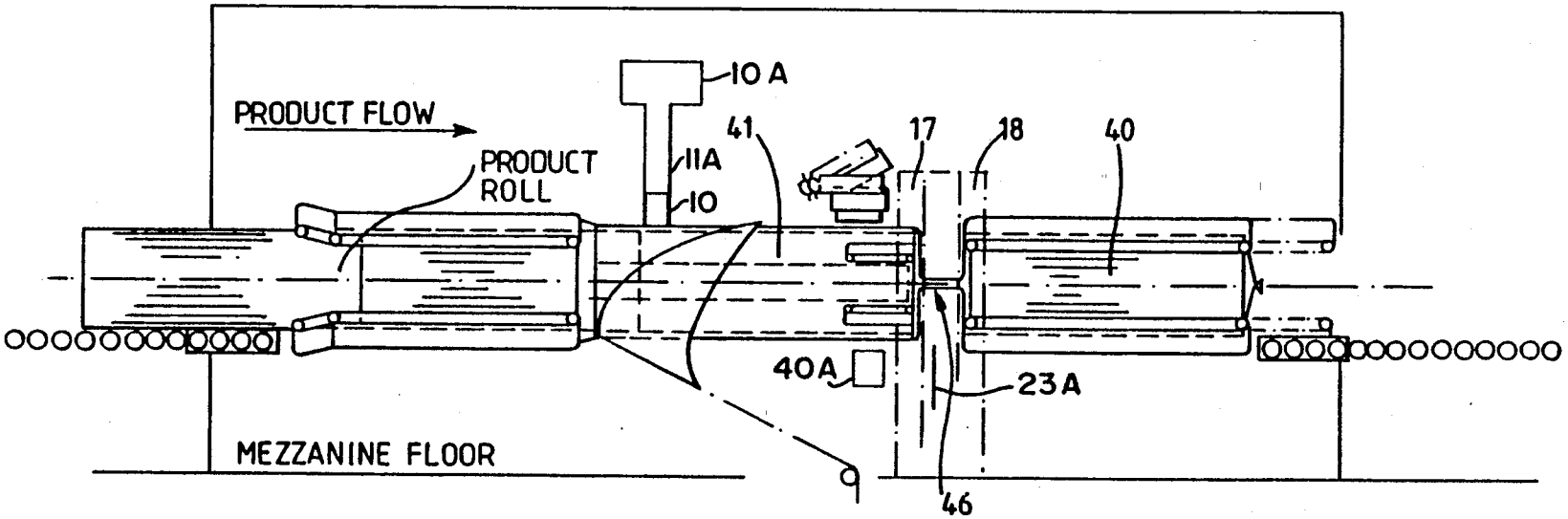

A typical operating cycle of the packing machine is shown in FIGS. 4 to 6.

FIG. 4 shows three product rolls 40, 41 and 42 in abutting relationship within the forming tube 6 and the belt feed conveyors 4. A fourth product roll 43 is shown leaving the take-off conveyors 24. Product roll 40 is shown in a fixed position with its end aligned with the downstream end of forming tube 6. It is held gripped in that position by product feed conveyors 8. The heat welder 15 is swung away from the plastic tube 44 which is held stationary by the plastic film feed conveyors 16. The plastic tube 44 is shown gathered at the end of product roll 40 and clipped and cut to form a small tail 45.

Now, by simultaneous operation of conveyors 4, 8, 16 and 24 the product roll 40 is moved forward from the forming tube 6 along with the plastic tube 44 which is fed forward at about the same rate. In practice it is found to be beneficial to feed the plastic tube 44 slightly slower than the product roll 4U in order to stretch the tube 44 over the roll 4Q. The heat welder 15 is lowered and activated whilst the plastic film feed conveyors 16 are in operation.

When the product roll 41 reaches the downstream end of the forming tube 6 the product feed conveyors 8 are stopped and product roll 41 is held in this position whilst product roll 40 continues to be moved downstream by the take-off conveyors 24 until its rearward facing end is clear of the gathering and clipping system 18, whereupon it is held at that position by stopping the take-off conveyors 24. Throughout the movement of product roll 40, plastic film has been continuously welded into plastic tube 44 and has been fed first onto product roll 40 and then allowed to stretch from the end of forming tube 6 to the back of product roll 40, thus forming a tube 46 enclosing a pocket 47 (shown in FIG. 5).

Throughout the packaging operational cycle vacuum is applied along the length of the product roll in the forming tube 6 by means of suction applied to the four perforated extraction ducts 9. This suction is created by connecting a bag filter 10A to pipes 11A leading from the extraction ducts 9 and nozzle to. The vacuum applied is equivalent to a column of about 500 mm of water. The advantage of using a bag filter to supply the suction in this way is that loose fibres in the product roll are removed and collected, thus preventing airborne fibres from contaminating the production environment and also beneficially reducing the dust and loose fibre content of the product.

Because product rolls are not exactly the same length, the precise position where roll 40 is held stationary is made variable so that pre-printed packaging can be kept in register with the product rolls. Take-off conveyors 24 stop the motion of product roll 40 when a registration mark on the plastic film 11 passes a photosensor system 40A (FIG. 6). By this means equal lengths of packaging can be used for rolls having the same nominal size.

The plastic film feed conveyors 16 continue to feed the plastic tube into the space between product rolls 40 and 41 after product roll 40 has ceased to move. The vacuum applied to the extraction ducts 9 and nozzle 10 causes the plastic tube to collapse into the pocket 47 until it disappears as shown at 46 in FIG. 6.

Towards the end of the collapse the horizontal gathering bars 19,20 are brought together and then the pistons 21 are brought together in the grooves in the gathering bars to gather the tube 46 tightly and clip it at the two clipping points generally indicated at 17 and 18. Thus closing the rear end of product roll 40 and the front end of product roll 41. The gathered plastic tube is now cut by knife 23A between the two clips and product roll 40 is carried away by conveyors 24 and 3. The cycle is now returned to the position shown in FIG. 4 except that product roll 40 has replaced roll 43 and roll 41 has replaced roll 40.

The position that the cut is made between the two clips is arranged to be nearer to one clip than the other so that a larger tail 50 (see FIG. 4) is generated on one end of the product roll to facilitate carrying by hand. Alternatively cuts can be made only between every second product roll to create two product rolls joined together by a collapsed length of plastic tube, which then serves as a carrying handle. Furthermore several rolls can be packed together between clipped portions to enable multiple packs to be produced.

Figure 4A:
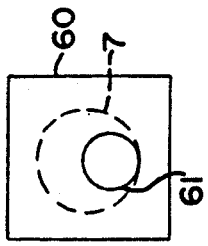

Thus far the operation of the packaging machine has been described only in relation to cylindrical product rolls which both start and finish with substantially the same diameter as the forming tube 6. It has been found that, by means of a minor modification, it is possible to use the machine to package product rolls having considerably smaller diameters than that of the s/ forming tube e.g. 350 mm diameter rolls in the case of a 450 mm diameter forming tube. This is possible by applying further suction to the nozzle 10 whilst positioning a baffle plate 60 with an eccentric 350 mm opening 61 at the upstream end of the forming tube 6 (see FIG. 4A). The extra vacuum thereby created within the forming tube 6 causes the 450 mm diameter plastic tube to be sucked onto the 350 mm diameter product roll to produce a neat tight package which, after clipping, retains its shape even if it is subsequently punctured.

Figure 7:
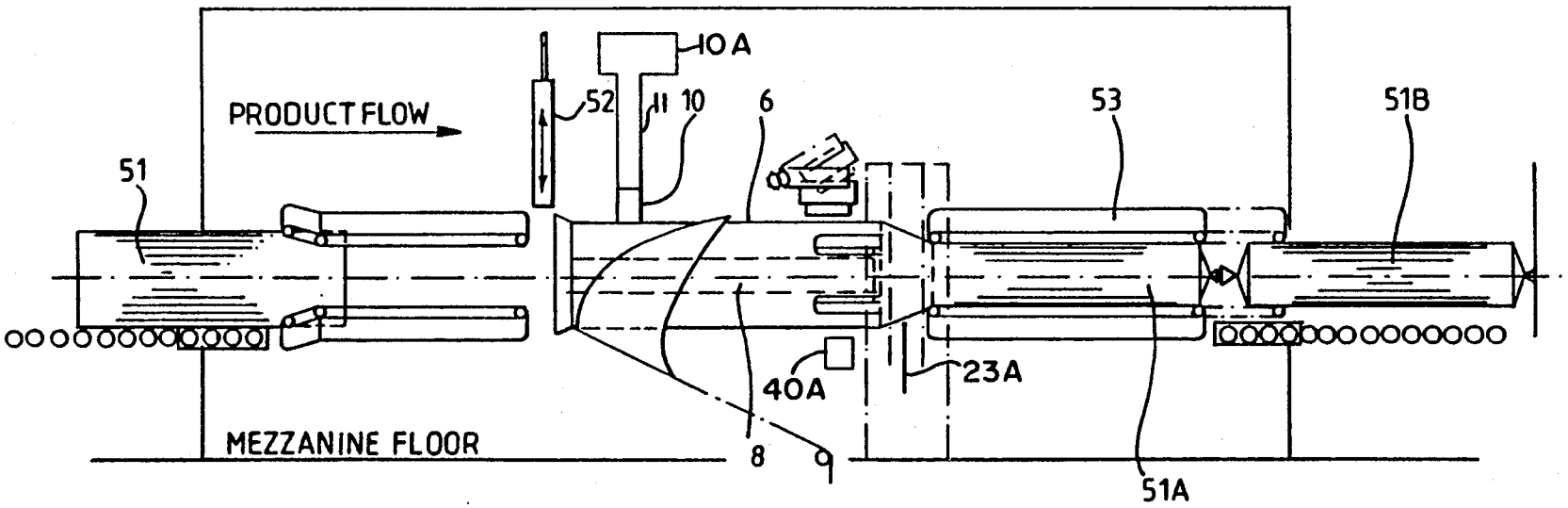
FIG. 7 shows a packing machine packing and shrinking the package by use of vacuum.

In a further modification of the invention it is possible to apply substantially more vacuum to nozzle 10 to cause a 450 mm product roll to be compressed by the higher pressure acting on the outside of the plastic tube, thereby creating packages of reduced size and higher density which can be transported more efficiently. The degree of compression can be further increased by arranging to supply product rolls to the forming tube one at a time through an air lock system (not shown). Alternatively a system such as that shown in FIG. 7 may be used. Here, with baffle plate 60 removed, 450 mm diameter product rolls. 51, are led into the forming tube 6 one at a time and a vacuum sealing plate 52 is lowered behind the product roll 51. Vacuum is then applied through nozzle 10 and ducts 9 until the reduced diameter product roll 51A is held in a compressed state downstream of the clipping system. Retaining means (not shown) may be used to prevent rearward motion of the roll 51A. It is then fully clipped and because it is airtight it remains as a package of substantially reduced size, 51B, when it emerges downstream of conveyors 53. The vacuum packed roll may then have a containment sleeve applied to hold the diameter down if the pack becomes punctured. By use of a larger diameter forming tube it is possible to use vacuum to compress the insulation from a size larger than 450 mm to a diameter of between 300 and 450 mm. Such products have been found to have better thickness recovery characteristics when unwrapped.

What is claimed is:

1. A packing machine for wrapping compressed insulation products in heat sealable plastic film, comprising:

a forming tube having an upstream end into which compressed insulation products may be fed and downstream end out of which they may be discharged, said forming tube including product feed conveyors and means to selectively operate said product feed conveyors to advance or hold stationary a compressed insulation product within said forming tube;

a former capable of reconfiguring a web of said plastic film as a plastic tube with a longitudinal opening;

a heat welder for closing the longitudinal opening and yielding a continuous plastic tube of plastic film around said forming tube;

plastic film feed conveyors for advancing said continuous plastic tube beyond the downstream end of said forming tube while said product feed conveyors are holding a said compressed insulation product stationary within said forming tube;

take-off conveyors located remotely from the downstream end of said forming tube and operable to displace a compressed insulation product discharged form said forming tube;

closure means located adjacent the downstream end of said forming tube and operable to form two adjacent closures in said continuous plastic tube;

a cutting tool operable to cut said continuous plastic tube between said two adjacent closures; and vacuum means operable to remove air form said forming tube and said continuous plastic tube downstream of said forming tube.

2. A packing machine according to claim 1, wherein said vacuum means includes a duct associated with an interior of said forming tube for extracting air from within said forming tube.

3. A packing machine according to claim 1, wherein said vacuum means includes at least one filter assembly.

4. A packing machine according to claim 1, and a baffle plate to seal around a continuous stream of substantially uniform cross-sectioned products entering said forming tube.

5. A packing machine according to claim 1, in which said forming tube is substantially a cylinder.

6. A packing machine according to claim 1, and a vacuum sealing plate to seal the upstream end of said forming tube, and said take-off conveyors are arranged to retain products at a reduced size whilst said closures are formed.

7. A process for wrapping compressed insulation products in heat sealable plastic film, comprising:

feeding units of comprised insulation product into an upstream end of a forming tube by means of product feed conveyors, said forming tube also having a downstream end from which units of compressed insulation product may be discharged;

stopping a first said unit of compressed insulation product as it reaches a position at the downstream end of said forming tube by stopping said product feed conveyors;

feeding a web of heat sealable plastic film around a former to generate a plastic tube, with a longitudinal opening, around said forming tube, expelling the first unit from said forming tube by action of the product feed conveyors whilst longitudinally heat welding said plastic tube and feeding it over the downstream end of said forming tube by means of operation of plastic film feed conveyors, to wrap around the first unit;

gripping the plastic tube containing the first unit by take-off conveyors and conveying the first unit until it is completely removed from said forming tube and is displaced from it by a preset distance whilst advancing a second said unit of compressed insulation product substantially to the downstream end of said forming tube by further operation of the product feed conveyors, thereby creating a pocket within said plastic tube in a space between an upstream end of the first unit and a downstream end of the second unit, wherein air is removed from said pocket between the first and second units by application of vacuum, and said plastic tube is fed into said space by further operation of said plastic film feed conveyors after the first unit has been displaced by said preset distance and during said application of vacuum; and then closing said plastic tube behind the first unit and ahead of the second unit.

8. A process according to claim 7, wherein the closing step includes gathering said plastic tube firstly in a first plane and then in a second plane substantially perpendicular to the first plane, and then fitting retaining means to hold the plastic tube in a gathered configuration.

9. A process according to claim 8, wherein said retaining means comprises a metal clip.

10. A process according to claim 7, in which the product is a roll of insulation material retained under compression by means of a cylindrical wrapping.

11. A process according to claim 10, in which said roll of insulation material has a diameter which is significantly less than the diameter of said forming tube and said plastic tube is caused to wrap tightly about said roll by the application of additional vacuum to the space above said roll within said forming tube and the use of a suitably shaped baffle plate across the upstream end of said forming tube to maintain the vacuum within said forming tube.

12. A process according to claim 10, in which said roll of insulation material is caused to have its average diameter reduced by the application of vacuum, whilst said forming tube is sealed by means of a vacuum sealing plate, said roll of insulation material then being held at the reduced diameter while said wrapping is closed to render its substantially airtight.

13. A process according to claim 10, in which said roll of insulation material has an initial diameter substantially the same as that of said forming tube and is caused to have its average diameter reduced by the application of vacuum, whilst said forming tube is sealed by means of a vacuum sealing plate, said roll of insulation material then being held at the reduced diameter while said wrapping is closed to render it substantially airtight.

14. A process according to claim 7, wherein the step of closing said plastic tube comprises forming a first closure behind said first unit and a second closure ahead of said second unit, the process further comprising the step of cutting said plastic tube between said first and second closures.

15. A process according to claim 7, including filtering said air removed from said pocket.

16. A process according to claim 7, wherein the plastic tube is formed from plastic film with preprinted markings, and wherein the process includes sensing said preprinted markings and adjusting said space between said first and second units to bring said markings into registry with successive said units.

* * * * *